US005093306A

United States Patent [19]

Mukoyoshi et al.

[11] Patent Number: 5,093,306

[45] Date of Patent: Mar. 3, 1992

[54] IMAGE-RECEIVING SHEET FOR THERMAL SUBLIMABLE DYE-TRANSFER RECORDING

[75] Inventors: Shunichiro Mukoyoshi; Tsunefumi Yamori, both of Hyogo, Japan

[73] Assignee: Kanzaki Paper Mfg. Co., Ltd., Tokyo, Japan

[21] Appl. No.: 487,781

[22] Filed: Mar. 5, 1990

[30] Foreign Application Priority Data

Mar. 6, 1989 [JP] Japan ..... 1-54759
Apr. 13, 1989 [JP] Japan ..... 1-95937

[51] Int. Cl.[5] ..... B41M 5/035; B41M 5/26

[52] U.S. Cl. ..... 503/227; 8/471; 428/141; 428/211; 428/913; 428/914

[58] Field of Search ..... 8/471; 428/195, 913, 428/914, 211; 503/227

[56] References Cited

U.S. PATENT DOCUMENTS 4,474,859 10/1984 Oshima et al. .

FOREIGN PATENT DOCUMENTS 32-107885 7/1957 Japan ..... 503/227
60-236794 11/1985 Japan ..... 503/227
2050193 3/1987 Japan ..... 503/227

*Primary Examiner*—Bruce H. Hess
*Attorney, Agent, or Firm*—Finnegan, Henderson, Farabow, Garrett and Dunner

[57] ABSTRACT

An image-receiving sheet for thermal sublimable dye-transfer recording is disclosed, comprising a base paper; a layer provided on said base paper, said layer being prepared by extrusion coating a molten thermoplastic polymer; and an image-receiving layer provided on said layer, said image-receiving layer comprising a solvent-free, radiation-curable resin composition which is dyeable with a sublimable dye and having been cured upon irradiation. The image-receiving sheet of the invention has high gloss and provides recorded images free from unevenness of printing and having high recorded density.

5 Claims, No Drawings

IMAGE-RECEIVING SHEET FOR THERMAL SUBLIMABLE DYE-TRANSFER RECORDING

FIELD OF THE INVENTION

The present invention relates to an image-receiving sheet for thermal transfer recording using a heat-sublimable dye. More particularly, it relates to an image-receiving sheet which has high gloss and provides recorded images free from unevenness of printing and having high recorded density.

BACKGROUND OF THE INVENTION

In recent years, full color recording systems for directly recording a still image photographed with a video camera and a still image on a television, a video tape recorder, a video disk, a computer, etc. on an image-receiving sheet are being developed. In particular, attention is now focused on a recording system in which a coloring sheet coated with a coloring material that is melted, vaporized, or sublimated by application of heat is superposed on an image-receiving sheet, and the coloring sheet is heated with a thermal head according to recording signals to transfer the coloring material to the image-receiving sheet, thus forming an image through adhesion, adsorption, or dye-fixing of the coloring material to the image-receiving sheet.

This recording system is generally characterized in that plain paper, a plastic film, or the like can be used as the image-receiving sheet since the coloring material on thc coloring sheet is melted, vaporized, or sublimated by application of heat.

However, in the case that a sublimable dye is employed as the coloring material, when plain paper, a plastic film, etc. is used as the image-receiving sheet, dye-fixing is, in particular, difficult to accomplish. As a result, there can only be obtained recorded images having low density and such images also have a defect of fading with time.

There has been therefore proposed a method in which a substrate is coated with a thermoplastic polyester resin or the like to provide an image-receiving layer (see, for example, U.S. Pat. No. 4,474,859). However, this proposed method involves such disadvantages that when plain paper is used as the substrate, penetration of the resin used in the image-receiving layer into the substrate occurs, and a coloring sheet cannot be brought into close contact with an image-receiving sheet at printing because of poor surface smoothness and cushioning properties of the image-receiving sheet, resulting in still insufficient image density and considerable unevenness of recorded images. Thus, image-receiving sheets of high quality are difficult to obtain by the above-proposed method. For improving the above problems, it is attempted to use as a substrate a so-called coated paper obtained by forming on a base paper a pigment coating layer comprising a pigment and a binder as main components. Although this substrate is improved in resin penetration and surface smoothness, it is still insufficient in cushioning properties, resulting in insufficient improvements in image density and unevenness of recorded images.

In the case that a plastic film is used as a substrate, recorded images free from unevenness and having high density can be obtained in some cases, because the surface smoothness is excellent, and some plastic films show good cushioning properties. However, because of high temperature at printing (a thermal recording head of a thermal transfer recording device is generally heated to 200° C. or higher), there is a problem that the surface of the plastic film is heat deformed, likely leading to occurrence of remarkable curling. Furthermore, the prudction cost is high as compared with that in which paper is used.

JP-A-60-236794 proposes an image-receiving sheet comprising a base paper, an interlayer formed on the base paper and comprised of a thermoplastic polymer which provides surface smoothness and cushioning properties, and an image-receiving layer formed on the interlayer. (The term "JP-A" as used herein means an "unexamined published Japanese patent application".)

The above image-receiving sheet, however, has been found to have the following problems. That is, the above proposed image-receiving sheet is generally produced by coating a solution of a thermoplastic resin, e.g., polyester resins or acetate resins, dissolved in a solvent on the interlayer and heat-drying the coating solution to form an image-receiving layer. If part of the solvent used remains in the image-receiving layer, the recorded image after the printing is inferior in storage stability (i.e., fading, oozing, etc. occur). If the drying is performed at a high temperature in order to completely remove the solvent, the interlayer comprised of a thermoplastic polymer undergoes deformation due to the high temperature to give poor appearance or impair surface smoothness and, as a result, recorded images free from unevenness and having high density cannot be obtained. On the other hand, if the drying is performed at a lower temperature in order to prevent deformation by heat, it takes much time, resulting in a very low productivity. In addition, since the solvent is harmful to human bodies and involves a fear of explosion, it is troublesome in handling and, further, it is expensive. Thus, there are problems from the standpoints of safety and cost.

In the case that the image-receiving layer is formed by use of an aqueous resin, it is superior in safety, etc. to those formed by use of a solvent-based resin. However, the former also requires a drying step which is accompanied by heat problems. Moreover, use of an aqueous resin is defective in that not only image-receiving sheets having poor surface gloss are merely obtained, but recorded images involve problems in storage stability because of inferior water resistance and moisture resistance.

In addition, as the method for forming an interlayer comprised of a thermoplastic polymer as described above, if a method in which a thermoplastic film is laminated on a base paper is employed, there are problems in occurrence of curling during the production and safety by a solvent. On the other hand, if a method in which a coating solution of a thermoplastic resin dissolved in a solvent is applied is employed, penetration of the solution into the base paper likely occurs, resulting in an insufficient improving effect in surface smoothness. Further, not only curling or unevenness likely occurs at drying, but there is a problem in safety by the solvent.

SUMMARY OF THE INVENTION

An object of the present invention is to provide an image-receiving sheet which has high gloss and provides recorded images free from unevenness and having high recording density and which is less apt to suffer from curling at printing and curling at production.

The above object of the present invention can be accomplished by an image-receiving sheet for thermal sublimable dye-transfer recording, comprising a base paper; a layer provided on said base paper, said layer being prepared by extrusion coating a molten thermoplastic polymer; and an image-receiving layer provided on said layer, said image-receiving layer comprising a solvent-free, radiation-curable resin composition which is dyeable with a sublimable dye and having been cured upon irradiation.

DETAILED DESCRIPTION OF THE INVENTION

The base paper employed in the image-receiving sheet of this invention is not particularly limited, and papers manufactured by generally known methods using a chemical or mechanical pulp as a main material can be employed. The base paper is, however, preferably one having a thickness of from about 25 to 300 μm and with good surface smoothness. Specific examples of the base paper include not only generally known woodfree paper but supercalendered paper, Yankee machine-dried paper, and glassine paper. In addition, pigment-coated papers such as art paper, coat paper, cast-coated paper, and baryta paper are particularly preferred because they are superior in surface smoothness and whiteness.

Examples of the component of the thermoplastic polymer layer provided on the base paper include polyethylene, polypropylene, polystyrene, polymethylpentene, polyethylene terephthalate, polymethyl methacrylate, polyvinyl chloride, cellulose acetate, nylons, ethylene-vinyl acetate copolymers, ethylene-acrylate copolymers, ethylene-acrylic acid copolymers, and ethylene-propylene copolymers. Among of these thermoplastic polymers are preferred those having a glass transition temperature of not higher than 40° C., more preferably from −130° C. to 40° C. because they are good in cushioning properties and excellent in image quality at a low energy during intermediate tone recording. Among them, polyethylene and polypropylene are inexpensive from the industrial standpoint and, hence, are preferably used.

A method for forming the thermoplastic polymer on the base paper is roughly classified into a method in which the thermoplastic polymer is dissolved in a solvent and then applied onto the base paper; a method in which the thermoplastic polymer is heat melted and extrusion coated on the base paper; and a method in which such a film of the thermoplastic polymer is laminated onto the base paper. However, the method for laminating a film invloves disadvantages that curling occurs during the production and that the production cost is too high because the film is expensive. Further, in the method in which the thermoplastic polymer is dissolved in a solvent and then applied onto the base paper, curling or unevenness occurs during the production, an improving effect for surface smoothness is lowered due to peneration of the resin, and there is a problem in safety by the solvent. On the contrary, according to the method in which the thermoplastic polymer is heat melted and extrusion coated on the base paper (generally called as "extrusion coating" or "extrusion lamination"), the formation of the thermoplastic polymer layer on the base paper is relatively easy, and curling does not occur during the production. Further, this method has a merit from the standpont of production cost and is excellent in safety.

Furthermore, the image-receiving sheet of the present invention may have a structure in which a thermoplastic polymer layer is provided on each of the both sides of a base paper and an image-receiving layer is provided on one side thereof. This structure is more effective in preventing the image-receiving sheet from occurrence of curling due to a moisture change or heat at printing.

Still further, when the surface of the thermoplastic polymer layer provided on the back side of the base paper is subjected to surface roughing, even when a plurality of image-receiving sheets are piled up, they do not adhere to one another but show good slipperiness. Thus, there can be obtained image-receiving sheets which show good running properties when used in letter printing or image printing by means of a thermal transfer printer. The surface roughing can be accomplished, for example, by a method for incorporating various pigments in the thermoplastic polymer or a method for forming the thermoplastic polymer layer and then subjecting to a mat roll treatment. Particularly preferred is a method in which a thermoplastic resin is extrusion coated and then pressed against a surface-roughed cooling roll, followed by allowing the coating to cool and solidify, because a roughed surface free from unevenness can be obtained with good efficiency in this method.

If desired, the thermoplastic polymer layer is added with additives such as dyes and antistatic agents in addition to the above-described various pigments.

The thermoplastic polymer layer has a thickness of from 0.1 to 100 μm, preferably from 1 to 50 μm. If the thickness is less than 0.1 μm, the desired effects can be hardly obtained. On the other hand, if the thickness exceeds 100 μm, the merit in production cost becomes poor.

On the thermoplastic polymer layer is then provided an image-receiving layer by curing a solvent-free, radiation-curable resin composition which is dyeable with a sublimable dye upon irradiation.

The above-described radiation-curable resin composition contains at least one radiation-curable monomer and/or oligomer as a main component. Such a monomer or oligomer is one containing a radiation-curable ethylenically unsaturated double bond or bonds in the molecule thereof.

Examples of suitable monomers are:

(a) carboxyl group-containing monomers represented by ethylenically unsaturated mono- or polycarboxylic acids, etc., and carboxylic acid salt group-containing monomers such as alkali metal salts, ammonium salts or amine salts of the foregoing carboxyl group-containing monomers, etc., (b) amido group-containing monomers represented by ethylenically unsaturated (meth)acrylamides, alkyl-substituted (meth)acrylamides, and vinyl lactams such as N-vinylpyrrolidone, etc., (c) sulfonic acid group-containing monomers represented by aliphatic or aromatic vinylsulfonic acids, and sulfonic acid salt group-containing monomers such as alkali metal salts, ammonium salts or amine salts, etc., of the foregoing sulfonic acid group-containing monomers, (d) hydroxyl group-containing monomers represented by ethylenically unsaturated ethers, (e) amino group-containing monomers such as dimethylaminoethyl (meth)acrylate-2-vinylpyridine, etc., (f) quaternary ammonium salt group-containing monomers,
(g) alkyl esters of ethylenically unsaturated carboxylic acids,
(h) nitrile group-containing monomers such as (meth)-acrylonitrile, etc.,
(i) styrene,
(j) esters of ethylenically unsaturated alcohols such as vinyl acetate and (meth)allyl acetate, etc.,
(k) mono(meth)acrylates of an alkylene oxide-addition polymer of a compound having active hydrogen,
(l) ester group-containing bifunctional monomers represented by diesters between a polybasic acid and an unsaturated alcohol,
(m) bifunctional monomers comprising a diester between an alkylene oxide-addition polymer of a compound having active hydrogen and (meth)acrylic acid,
(n) bisacrylamides such as N,N-methylenebisacrylamide, etc.,
(o) bifunctional monomers such as divinylbenzene, divinylethylene glycol, divinyl sulfone, divinyl ether, and divinyl ketone, etc.,
(p) ester group-containing polyfunctional monomers such as polyesters between a polycarboxylic acid and an unsaturated alcohol, etc.,
(q) polyfunctional monomers comprising a polyester between an alkylene oxide-addition polymer of a compound having active hydrogen and (meth)acrylic acid, and
(r) polyfunctional unsaturated monomers such as trivinylbenzene, etc.

Examples of suitable oligomers are:
(a) poly(meth)acrylates of a from di- to hexahydric aliphatic, alicyclic or araliphatic alcohol and a polyalkylene glycol,
(b) poly(meth)acrylates of a polyhydric alcohol in which an alkylene oxide is added to a from di- to hexahydric aliphatic, alicyclic, araliphatic or aromatic alcohol,
(c) poly(meth)acryloyloxyalkyl phosphates,
(d) polyester poly(meth)acrylates,
(e) epoxy poly(meth)acrylates,
(f) polyurethane poly(meth)acrylates,
(g) polyamide poly(meth)acrylates,
(h) organo(poly)siloxane poly(meth)acrylates,
(i) vinyl- or diene-based oligomers having a (meth)acryloyloxy group or groups at the side chain or chains and/or terminal or terminals thereof, and
(j) the oligomers (a) to (i) enumerated above, modified with an oligoester (meth)acrylate.

These monomers and oligomers can be used either individually or as a mixture of two or more thereof. In the latter case, a mixing ratio must be selected properly because too a high proportion of the polyfunctional monomer and/or oligomer brings about too a high curing density to reduce the image density, and too a high proportion of the monofunctional monomer results in reduction of image storage stability or coating film strength. Further, too a high glass transition temperature of the radiation-curable resin after curing results in reduction of dyeability with a sulblimable dye. On the contrary, if the glass transition temperature is too low, the surface of the image-receiving sheet becomes tacky so that blocking likely occurs, or the storage stability of image is reduced. Therefore, suitable monomers and/or oligomers should be selected (which cannot be unequivocally defined but is, for example, from about 0° to 120° C. in terms of glass transition temperature). Still further, it is preferable that the resin composition contains a bond or a functional group which serves to improve dyeability. Examples of such a bond include an ester bond, a urethane bond, an amide bond, and a urea bond. Those having a segment such as polystyrene, polyacrylonitrile, styrene-acrylonitrile copolymers, and polyvinyl chloride are also preferable.

It is preferable to incorporate a radiation-curable silicone compound in an amount of from about 0.01 to 10% in the radiation-curable resin. The incorporation of such a silicone compound is more effective in prevention of blocking (a phenomenon in which the coloring sheet and the image-receiving sheet are fused with each other and the both sheets are difficult to peel apart after recording, or the ink layer itself of the coloring sheet is transferred to the image-receiving sheet) since the silicone compound undergoes copolymerization with other radiation-curable resin components, whereby the resulting image-receiving layer is endowed with excellent heat resistance, slipperiness, and releasability of the silicone compound. Examples of the radiation-curable silicone compound include organo(poly)siloxane (poly)(meth)acrylates in which a radiation-reactive group such as a (meth)acryloyl group is introduced into an organo(poly)siloxane compound.

It is also preferable to incorporate a macromonomer in an amount of from about 5 to 70% as part of the radiation-curable resin composition because the dyeability, storage stability and other are apt to be further improved. The macromonomer as referred to herein means an oligomer generally having a number average molecular weight of from about 500 to 50,000 and having a radical polymerizable functional group, preferably (meth)acryloyl group, introduced in one of the terminal ends thereof. Examples of the skeleton of the macromonomer include polymers of various vinyl monomers (such as alkyl (meth)acrylates and styrene), oxyethylene, or dimethylsiloxane. Of these, a polymer of styrene or a copolymer of styrene and acrylonitrile is particularly preferred as the skeleton because use of such a macromonomer results in excellent dyeability and storage stability.

If desired, the resin composition may further contain various auxiliary agents such as white pigments, coloring pigments, dyes, non-radiation-curable resins, wetting agents, defoaming agents, dispersing agents, antistatic agents, levelling agents, and lubricating agents, so far as the desired effects of this invention are not hindered thereby. In order to further improve releasability from the coloring ink sheet, the image-receiving layer may contain a small amount of a release agent other than the aforementioned radiation-curable silicone compound.

Examples of the release agent include solid waxes, e.g., polyethylene wax, amide wax, and Teflon® powder, fluorine-containing or phosphate type surface active agents, and silicone oil.

The dry weight of the resin composition to form an image- receiving layer is regulated in the range of from about 0.1 to 50 g/m$^2$, preferably from about 1 to 10 g/m$^2$, on a solids basis. If the dry weight is less than 0.1 g/m$^2$, the desired effects can be hardly obtained, whereas a dry weight of more than 50 g/m$^2$ produces no further improvement and has no economical merit.

The method of coating the resin composition is not particularly restricted, and commonly employed coating means, such as a bar coater, a roll coater, an air knife coater, and a gravure coater can be used appropriately.

The surface to be coated with the resin composition may, of course, be pretreated by corona discharge treatment, radiation treatment, plasma treatment, etc. to improve wettability of the surface to be coated or to improve adhesion of the coated layer.

The radiations for curing the coating composition includes ultraviolet rays, $\alpha$-rays, $\beta$-rays, $\gamma$-rays, X-rays, and electron beams. However, since $\alpha$-rays, $\beta$-rays, $\gamma$-rays, and X-rays are accompanied by a danger to human bodies, ultraviolet rays and electron beams which are easy to handle and widely spread in industry are preferred. In particular, an electron beam irradiation is more preferred than the ultraviolet ray irradiation because of not only higher productivity but freedom from such problems as generation of stinks, coloration, and reduction of storage stability, all arising from a photo-initiator added.

In using electron beams, the exposed irradiation dose is preferably regulated in the range of from about 0.1 to 20 Mrad. With a dose of less than 0.1 Mrad, sufficient irradiation effects may not be obtained. With a dose exceeding 20 Mrad, there is a fear for the subsrate such as paper or some plastic films to be impaired. Electron beams may be irradiated by, for example, the scanning type, curtain beam type, broad beam type accelerator, or the like. The accelerating voltage in the electron beam irradiation suitably ranges from about 100 to 300 kV. In using ultraviolet rays, the resin composition must contain a photo-initiator. Examples of the photo-initiator include thioxanthone, benzoin, benzoin alkyl ether xanthones, dimethylxanthone, benzophenone, anthracene, 2,2-diethoxyacetophenone, benzyl dimethyl ketal, benzil, diphenyl disulfide, anthraquinone, 1-chloroanthraquinone, 2-ethyl-anthraquinone, 2-tert-butylanthraquinone, N,N'-tetraethyl-4,4'-diaminobenzophenone, and 1,1-dichloroacetophenone, etc. These photo-initiators may suitably be used alone or in combination of two or more thereof.

The amount of the photo-initiator used is preferably from about 0.2 to 10% by weight, more preferably from about 0.5 to 5% by weight, based on the total amount of the composition. In addition to the photo-initiator described above, a tertiary amine such as triethanolamine, 2-dimethylaminoethanol, dimethylaminobenzoic acid, isoamyl dimethylaminobenzoate, dioctylaminobenzoic acid, and lauryl dimethylaminobenzoate may be incorporated in an amount of from about 0.05 to 3% by weight based on the total amount of the composition, in order to accelerate the curing.

Suitable irradiation sources of ultraviolet rays include about 1 to 50 ultraviolet lamps (including low-, medium- or high-pressure mercury vapor lamps having a working pressure of, for example, from about few mmHg to about 10 atms.), xenon lamps, and tungsten lamps. Ultraviolet rays having an intensity of from about 5,000 to 8,000 $\mu W/cm^2$ are preferably used.

The image-receiving sheet for thermal sublimable dye-transfer recording according to the present invention is excellent not only in quality as described above but also in productivity and safety because the image-receiving layer can be produced in a solvent-free state. In addition, because the production of the image-receiving layer does not involve evaporation of a solvent, the surface having high gloss and high smoothness can be obtained.

The present invention is now illustrated in greater detail by way of the following Examples and Comparative Examples, but it should be understood that the present invention is not construed as being limited thereto. In these examples, all parts are by weight.

EXAMPLE 1

A commercially available coat paper having a basis weight of 120 $g/m^2$ and having a pigment-coated layer on the both sides thereof was adopted for a base paper. A molten low-density polyethylene resin having a glass transition temperature of $-20°$ C. was extrusion coated on the both sides of the above coat paper, followed by pressing and solidification by means of cooling rolls to form a thermoplastic polymer layer. The dry weight of the polyethylene on each side was 20 $g/m^2$. Subsequently, one side of the thus formed thermoplastic polymer layer was coated with a radiation-curable resin composition consisting of 35 parts of Macromonomer AN-6 (a macromonomer produced by Toagosei Chemical Industry Co., Ltd., having a number average molecular weight of about 6,000 and consisting of an oligomer comprising as a main component a styrene-acrylonitrile copolymer with a methacryloyl group bonded in one terminal end thereof), 45 parts of tolyloxyethyl acrylate, 10 parts of N-vinylpyrrolidone, 10 parts of pentaerythritol triacrylate, and 0.5 part of silicone diacrylate ("EBECRYL® 350", a trade name of Daicel UCB Co., Ltd.) to a dry weight of 5 $g/m^2$. The coat was then irradiated with 5 Mrad of electron beams using an electron beam accelerator ("Electrocurtain® CB-150" manufactured by Energy Science Inc.) to form an image-receiving layer. Thus, an image-receiving sheet was obtained.

EXAMPLE 2

An image-receiving sheet was obtained in the same manner as in Example 1, except that a composition consisting of 65 parts of a urethane acrylate oligomer ("UVU-820-OL", a trade name of Sanyo Chemical Industries, Ltd.), 30 parts of tolyloxyethyl acrylate, 5 parts of pentaerythritol triacrylate, and 0.5 part of silicone diacrylate ("EBECRYL® 350", a trade name of Daicel UCB Co., Ltd.) was used as the radiation-curable resin composition for image-receiving layer.

EXAMPLE 3

An image-receiving sheet was obtained in the same manner as in Example 1, except that a paper obtained by passing a wood-free paper having a basis weight of 100 $g/m^2$ through a roll nip formed from a metal roll and an elastic roll made of cotton, followed by smoothening treatment was used as the base paper.

EXAMPLE 4

An image-receiving sheet was obtained in the same manner as in Example 1, except that a cast coated paper having a basis weight of 120 $g/m^2$ was used as the base paper and that a thermoplastic polymer layer was formed by extrusion coating a molten low-density polyethylene resin having a glass transition temperature of $-20°$ C. on the cast coated side of the base paper, followed by pressing and solidification by means of cooling rolls.

EXAMPLE 5

Using the same commercially available coat paper as in Example 1 as the base paper, an image-receiving sheet was produced as follows. A molten low-density polypropylene resin having a glass transition temperature of −10° C. was extrusion coated on one side of the above coat paper, followed by pressing and solidification by means of cooling rolls to form a thermoplastic polymer layer. On this layer, an image-receiving layer was then formed in the same manner as in Example 1.

EXAMPLE 6

Using a cast coated paper having a basis weight of 105 g/m$^2$ as the base paper, an image-receiving sheet was produced as follows. A molten polypropylene resin having a glass transition temperature of −10° C. was extrusion coated on the cast coated side of the paper, followd by pressing and solidification by means of cooling rolls having a mirror surface. On the other hand, the back side of the paper was extrusion coated with the above molten polypropylene resin, and the coat was pressed and solidified by means of cooling rolls, the surfaces of which had been finely roughened by sandblasting. Thus, the base paper was provided on the both sides with a thermoplastic polymer layer to a dry weight of 20 g/m$^2$. Subsequently, an image-receiving layer was formed on the thermoplastic polymer layer provided on the cast coated side in the same manner as in Example 1.

COMPARATIVE EXAMPLE 1

An image-receiving sheet was obtained in the same manner as in Example 1, except that a thermoplastic polymer layer was not formed and that an image-receiving layer was formed directly on the pigment-coated layer.

COMPARATIVE EXAMPLE 2

An image-receiving sheet was directly produced by forming the same image-receiving layer as in Example 1 on a polypropylene-based synthetic paper having a basis weight of 150 g/m$^2$.

COMPARATIVE EXAMPLE 3

Using the same commercially available coat paper as in Example 1 as the base paper, an image-receiving sheet was produced as follows. A molten low-density polypropylene resin having a glass transition temperature of −10° C. was extrusion coated on one side of the base paper, followed by pressing and solification by means of cooling rolls to form a thermoplastic polymer layer. The dry weight of the polyethylene was 20 g/m$^2$. The thus formed thermoplastic polymer layer was coated with a coating composition obtained by dissolving 100 parts of a polyester resin ("Vylon ® 200", a trade name of Toyobo Co., Ltd.) and 0.5 part of silicone oil in 400 parts of toluene and 400 parts of methyl ethyl ketone to a dry weight of 5 g/m$^2$, followed by drying at 120° C. for 3 minutes to form an image-receiving layer.

COMPARATIVE EXAMPLE 4

The same wood-free paper as in Example 3 was used as the base paper, and one side thereof was laminated with a 25 μm thick polyethylene terephthalate film using a urethane-based solvent type adhesive. On this polyethylene terephthalate film was then formed the same image-receiving layer as in Example 1.

COMPARATIVE EXAMPLE 5

The same wood-free paper as in Example 3 was used as the base paper, and one side thereof was coated with a coating composition comprising 10 parts of an ethylene-vinyl acetate copolymer dissolved in 90 parts of a toluene/ethyl acetate (1:1) mixed solvent to a dry weight of 10 g/m$^2$, followed by drying to form a thermoplastic polymer layer. On this thermoplastic polymer layer was then formed the same image-receiving layer as in Example 1.

Each of the image-receiving sheets obtained in Examples 1 to 6 and Comparative Examples 1 to 5 was evaluated as follows.

An ink sheet for Hitachi color video printer (a coloring ink sheet for thermal transfer recording, coated with an ink composition containing a sublimable dye) was superposed on the image-receiving sheet, and thermal sublimable dye-transfer recording was conducted using a color video printer ("Hitachi Color Video Printer VY-50" manufactured by Hitachi, Ltd.). The recorded images were evaluated for density, unevenness of image, and curling at printing as follows. Further, the image-receiving sheets obtained above were also evaluated for gloss.

Still further, curling at production during the formation of the thermoplastic polymer layer on the base paper was evaluated.

The results obtained are shown in Table 1.

Recorded Image Density

The maximum density of the recorded blue image was measured with a Macbeth Densitometer. The results obtained are shown in Table 1, in which the higher the value, the higher the recorded density.

Unevenness of Image

The unevenness of image was visually evaluated on the recorded blue image. The results obtained are shown in Table 1.

Excellent: Substantially no unevenness of image was observed, and the image had a smooth surface.

Good: Slight unevenness of image was observed, but acceptable for practical use.

Not good: Considerable unevenness of image was observed such that there were problems for practical use.

Poor: Remarkable unevenness of image was observed.

Curling at Printing

The curling was visually evaluated after printing. The results obtained are shown in Table 1.

Excellent: Substantially no curling was observed.

Good: Slight curling was observed, but acceptable for practical use.

Poor: Considerable curling was observed.

Gloss

The surface gloss of each image-receiving sheet was visually evaluated. As a result, it was found that the image-receiving sheets obtained in all the Examples and in Comparative Examples 1 and 2 had highly glossy surfaces, whereas that obtained in Comparative Example 3 had a lowly glossy and somewhat rough surface.

Curling at Production

The curling at production during the formation of the thermoplastic polymer layer on the base paper was visually evaluated. The results obtained are shown in Table 1.

Good: Substantially no curling was observed.

Not good: Slight curling was observed, but acceptable for practical use.

Poor: Considerable curling was observed, and the running by the printer became impossible whereby printing could not be effected.

TABLE 1

| | Recorded Density | Unevenness of Image | Curling at Printing | Curling at Production |
|---|---|---|---|---|
| Example | | | | |
| 1 | 1.65 | Excellent | Excellent | Good |
| 2 | 1.60 | Excellent | Excellent | Good |
| 3 | 1.55 | Good | Excellent | Good |
| 4 | 1.67 | Excellent | Good | Good |
| 5 | 1.60 | Excellent | Good | Good |
| 6 | 1.65 | Excellent | Excellent | Good |
| Comparative Example | | | | |
| 1 | 1.45 | Poor | Good | Good |
| 2 | 1.70 | Excellent | Poor | Good |
| 3 | 1.55 | Poor | Good | Not good |
| 4 | — | — | — | Poor |
| 5 | 1.50 | Not good | Good | Not good |

As is apparent from the above results, each of the image-receiving sheets obtained in the Examples according to the present invention provides recorded images having high recorded density and free from unevenness of image, with little curling at printing and production, and has high gloss. Therefore, the image-receiving sheet of this invention is of extremely high commercial value. Because no solvent is used in forming the image-receiving layer, the image-receiving sheet is extremely advantageous from the standpoints of productivity and safety. Furthermore, the image-receiving sheet obtained in Example 6, which is provided on the back side thereof with a thermoplastic polymer layer having a roughened surface, shows extremely good printer-running properties in that when a plurality of such image-receiving sheets are subjected to continuous recording by means of a thermal dye-transfer printer, the sheets can be fed successively without overlapping one another.

While the invention has been described in detail and with reference to specific embodiments thereof, it will be apparent to one skilled in the art that various changes and modifications can be made therein without departing from the sprit and scope thereof.

What is claimed is:

1. An image-receiving sheet for thermal sublimable dye-transfer recording, comprising a base paper; a layer provided on said base paper, said layer being prepared by extrusion coating a molten thermoplastic polymer; and an image-receiving layer provided on said layer, said image-receiving layer comprising a resin which has been prepared by radiation-curing a solvent-free radiation-curable resin composition, said radiation-curable resin composition containing at least one of a monomer or an oligomer containing one or more radiation-curable ethylenically unsaturated double bonds in a molecule thereof, said resin composition being dyeable with a sublimable dye.

2. An image-receiving sheet for thermal sublimable dye-transfer recording as claimed in claim 1, wherein said base paper is provided on the back side thereof with a thermoplastic polymer layer.

3. An image-receiving sheet for thermal sublimable dye-transfer recording as claimed in claim 2, wherein the surface of said thermoplastic material layer provided on the back side of said base paper is roughed.

4. An image-receiving sheet for thermal sublimable dye-transfer recording as claimed in claim 1, wherein said base paper is a pigment-coated paper.

5. An image-receiving sheet for thermal sublimable dye-transfer recording as claimed in claim 1, wherein the thermoplastic polymer layer comprises a resin having a glass transition temperature of not higher than 40° C.

* * * * *